US010516960B2

(12) United States Patent
Doolittle et al.

(10) Patent No.: US 10,516,960 B2
(45) Date of Patent: Dec. 24, 2019

(54) AUTOMATIC SPEAKER RELATIVE LOCATION DETECTION

(71) Applicant: Avnera Corporation, Beaverton, OR (US)

(72) Inventors: Colin Doolittle, Portland, OR (US); Amit Kumar, Portland, OR (US); David Wurtz, Portland, OR (US); Michael Wurtz, Lake Oswego, OR (US); Manpreet Khaira, Portland, OR (US); Meenakshi Barjatia, Portland, OR (US)

(73) Assignee: AVNERA CORPORATION, Beaverton, OR (US)

( * ) Notice: Subject to any disclaimer, the term of this patent is extended or adjusted under 35 U.S.C. 154(b) by 0 days.

(21) Appl. No.: 16/013,073

(22) Filed: Jun. 20, 2018

(65) Prior Publication Data

US 2019/0215634 A1 Jul. 11, 2019

Related U.S. Application Data

(60) Provisional application No. 62/614,992, filed on Jan. 8, 2018.

(51) Int. Cl.

| | |
|---|---|
| ***H04S 7/00*** | (2006.01) |
| ***H04R 1/40*** | (2006.01) |
| ***H04R 5/02*** | (2006.01) |
| ***H04R 5/04*** | (2006.01) |
| ***H04R 3/00*** | (2006.01) |
| ***H04S 3/00*** | (2006.01) |

(52) U.S. Cl.

CPC ..... *H04S 7/301* (2013.01); *H04R 1/406* (2013.01); *H04R 5/02* (2013.01); *H04R 5/04* (2013.01); *H04S 3/008* (2013.01); *H04S 2400/01* (2013.01)

(58) Field of Classification Search

CPC ..... H04S 7/301; H04S 3/008; H04S 2400/01; H04R 1/406; H04R 5/02; H04R 5/04

USPC ..... 381/303; 700/94

See application file for complete search history.

(56) References Cited

U.S. PATENT DOCUMENTS

| | | | | |
|---|---|---|---|---|
| 7,676,044 | B2 * | 3/2010 | Sasaki | H04S 7/302 381/303 |
| 2015/0208188 | A1 * | 7/2015 | Carlsson | H04R 29/001 381/79 |
| 2017/0238114 | A1 * | 8/2017 | Milne | H04W 4/80 381/79 |

* cited by examiner

*Primary Examiner* — Vivian C Chin
*Assistant Examiner* — Douglas J Suthers
(74) *Attorney, Agent, or Firm* — Miller Nash Graham & Dunn LLP

(57) ABSTRACT

An audio speaker system for a home theater including a number of microphones, a number of speakers, each speaker located at a different location in a room, and a processor electrically connected to the plurality of microphones and wirelessly connected to the plurality of speakers. The processor is configured to generate an audio signal to send to each speaker of the plurality of speakers, output audio from each speaker of the plurality of speakers based on the audio signal, receive the audio at each microphone from each speaker of the plurality of speakers, determine a location of each speaker relative to the plurality of microphones based on the received audio at each microphone, and assign an audio channel to each speaker based on the determined location.

21 Claims, 4 Drawing Sheets

AUTOMATIC SPEAKER RELATIVE LOCATION DETECTION

CROSS REFERENCE TO RELATED PATENT APPLICATIONS

This application claims benefit of U.S. Provisional Application No. 62/614,992, filed Jan. 8, 2018, titled AUTOMATIC SPEAKER RELATIVE LOCATION DETECTION, which is incorporated by reference herein in its entirety.

TECHNICAL FIELD

Embodiments of the disclosure are directed to an audio system, and, more particularly, to an audio system for automatically identifying relative speaker locations in a home theater system that includes multiple audio speakers.

BACKGROUND

In a traditional wired home theater system, each speaker of a multi-speaker system is physically connected by a speaker wire to a particular audio output channel. Thus, it is easy to discern which speaker is connected to which audio output channel. Wireless speaker systems, on the other hand, lack a speaker wire to connect to a particular audio output channel, and therefore there is no wired connection between a particular speaker and its associated audio output channel. Instead, existing wireless systems require a user to search each speaker for a label identifying to which pre-determined channel the speaker is connected. For example, in a four-speaker system, four otherwise identical-looking speakers must be examined to find these labels, and then the speakers are physically placed around the room according to their labels (i.e, front left, front right, left rear, and right rear).

Even after deciphering this labeling scheme, however, the user may be confused as to what 'left' and 'right' mean on the labels. For example, does the 'left' or 'right" mean as the user is facing a TV or as the TV faces the room? Further, a user may neglect to notice the labels and/or does not correctly place the speakers according to the labeled positions. The user may not notice the speakers are misplaced, which may degrade the home theater experience.

Embodiments of the disclosure address these and other limitations of the prior art.

DETAILED DESCRIPTION

Embodiments of the disclosure automatically determine a relative position of speakers within a multi-speaker home theater system by analyzing, at two or more microphones, an output from individual speakers and comparing the output of each speaker to each other, as well as the microphones. In some embodiments, the outputs of the speakers are recorded prior to, or coincident with, the analysis.

Figure 1:
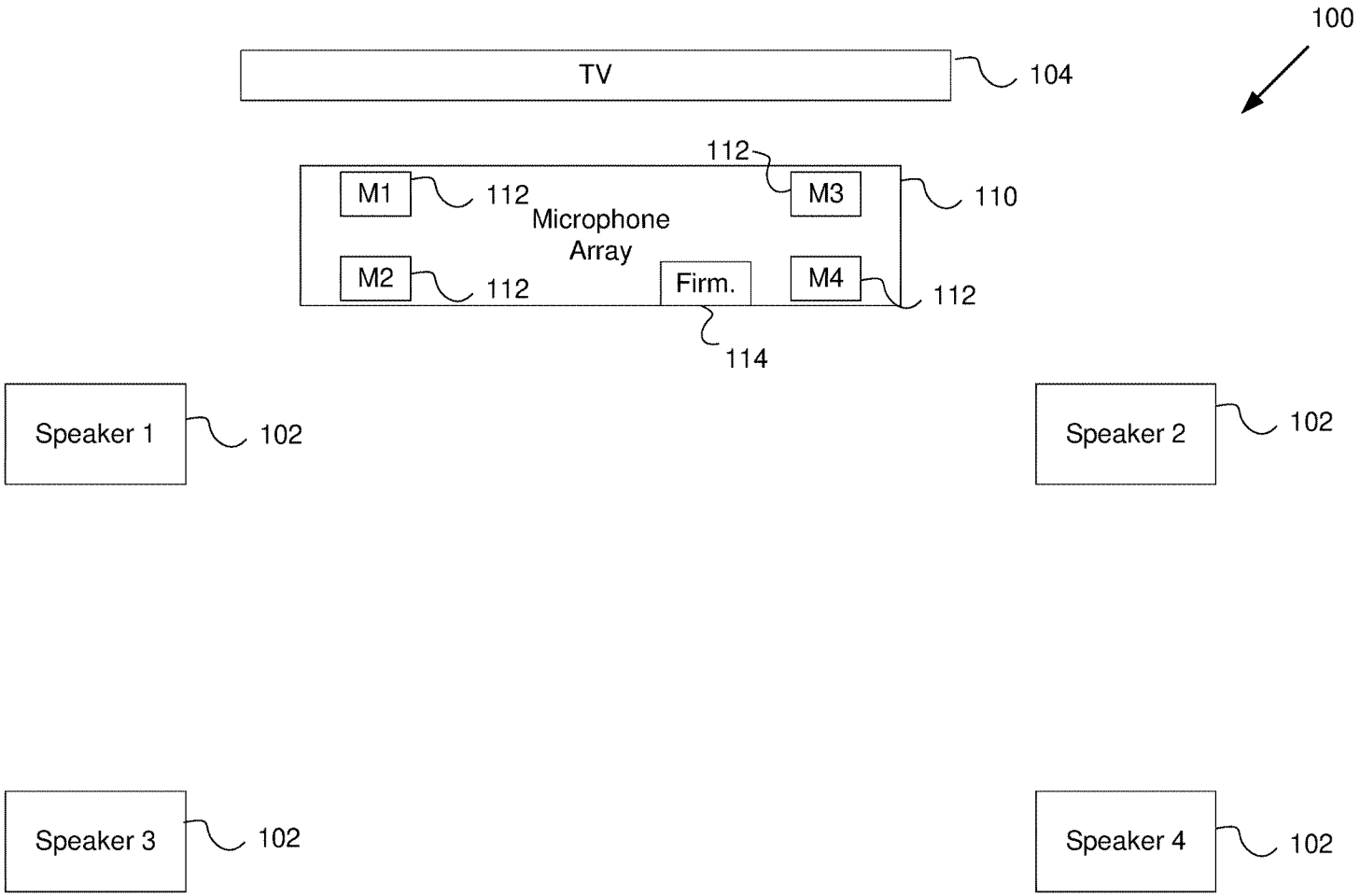
FIG. 1 is a block diagram of an automatic speaker relative location detection system according to embodiments of the disclosure.

FIG. 1 is an example block diagram of an automatic speaker relative location detection system 100 according to some embodiments of the disclosure. FIG. 1 illustrates relative positions of speakers 102 within a room. FIG. 1 is illustrated as a "top-down" or birds-eye view of an audio listening area, such as in a home theater setup. For ease of discussion and illustration, four speakers 102 are shown in various positions around the room in FIG. 1. However, embodiments of the disclosure are not limited to four speakers, as will be discussed in more detail below.

Figure 2:
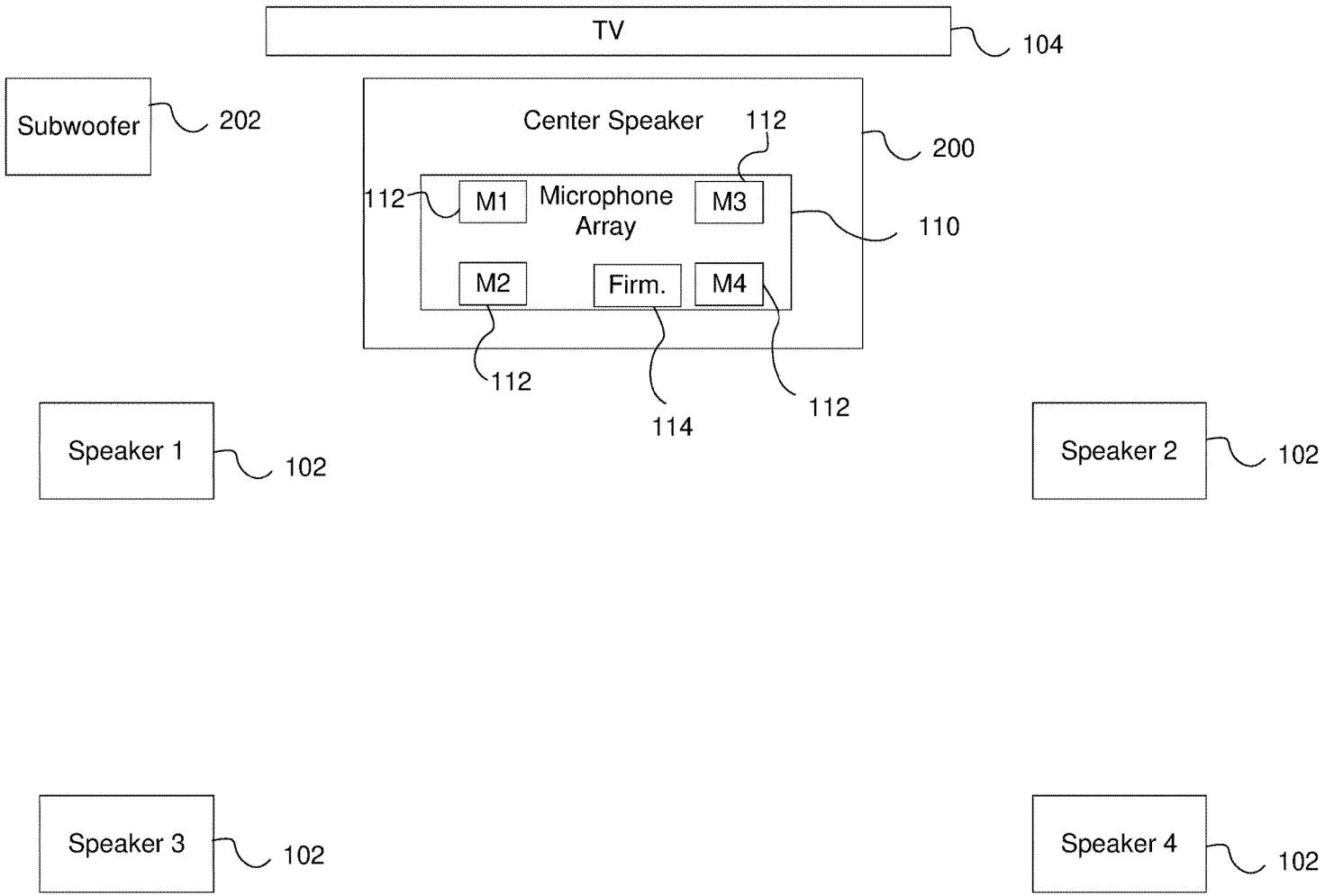
FIG. 2. is a block diagram of another automatic speaker relative location detection system according to other embodiments of the disclosure.

A television 104 is located at one edge of the room. A microphone array 110 is located near the television 104, but it is not necessary that the microphone array 110 be located in the illustrated position, as will be discussed in further detail below. In other words, embodiments of the disclosure may work with the microphone array 110 located in other positions relative to the other components of the home theatre system 100. The microphone array 110, may be included, for example, in a sound bar under or in front of the television 104, as shown in FIG. 2, as often included in home theaters systems, or may be a separate device. The microphone array 110 may include firmware 114, which may be used to control and/or implement the location detection described below. The firmware 114, however, in some embodiments may be included in a device or component separate from the microphone array 110.

The microphone array 110 includes more than one microphone 112 physically spaced apart from one another. In the illustrated embodiment of FIG. 1, the microphone array 110 includes four microphones 112 set in a rectangular arrangement. The rectangular arrangement of the microphones 112 provides physical offset in two directions, x, and y, where x and y create a coordinate system of the room as seen from an "overhead view", i.e., the z dimension spans from floor to ceiling.

The coordinates of the microphones 112 are characterized and stored in the firmware 114 of the microphone array 110, or of the soundbar, for later use in the analysis. The arrangement of the microphones 112 need not be rectangular, although a rectangular shape is convenient when the microphone array 110 is located within a soundbar. In other words, the microphones 112 in the microphone array 110 may be arranged differently than illustrated. The arrangements and coordinates of the microphones 112 are characterized and stored for use in the analysis of stimulus recordings from the microphones 112 no matter which arrangement is used for the microphones 112.

Figure 3:
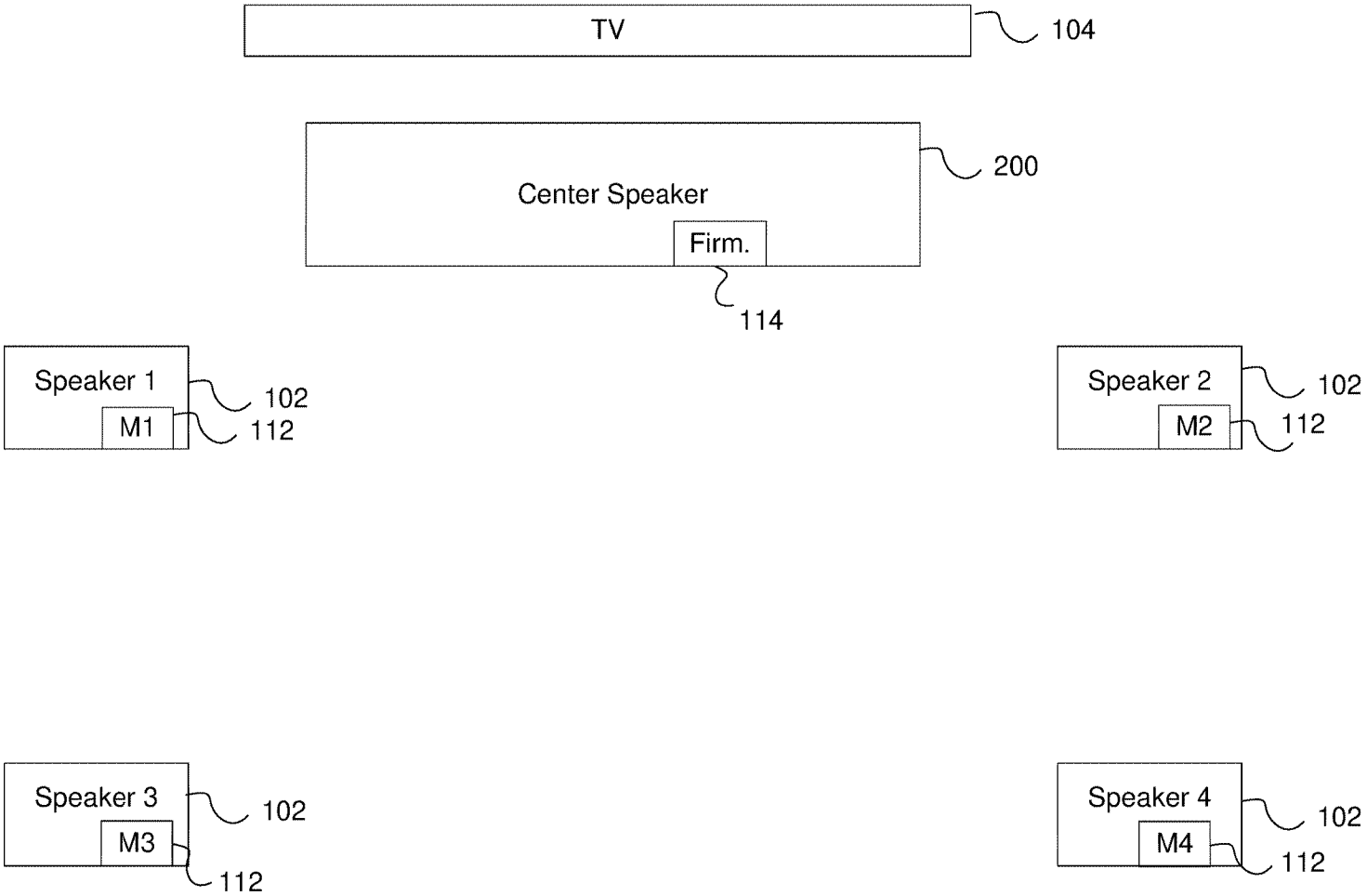
FIG. 3 is a block diagram of another automatic speaker relative location detection system according to other embodiments of the disclosure.

FIGS. 2 and 3 illustrate alternative configurations of the automatic speaker relative location detection system 100, where like components are indicated with the same reference numeral. For example, in FIG. 2, the microphone array 110 may be included in a center speaker 200, or sound bar, which is generally provided in front of the TV 104. The plurality of speakers may also include a subwoofer 202. In FIG. 3, rather than having a microphone array 110 included as a separate device or in a center speaker 200, each speaker 102 may include a microphone 112. Firmware 114 may be included in any of the speakers 102, the center speaker 200, or as a separate device. In some embodiments, one or more of the speakers 102 or center speaker 200 may not be induced. As will be discussed in further detail below, the firmware 114 can determine the location of each speaker 102 relative to the other speakers 102 based on the recordings of each microphone 112 in each speaker 102. In some embodiments, the center speaker 200 may also include a microphone 112 (not shown).

Figure 4:
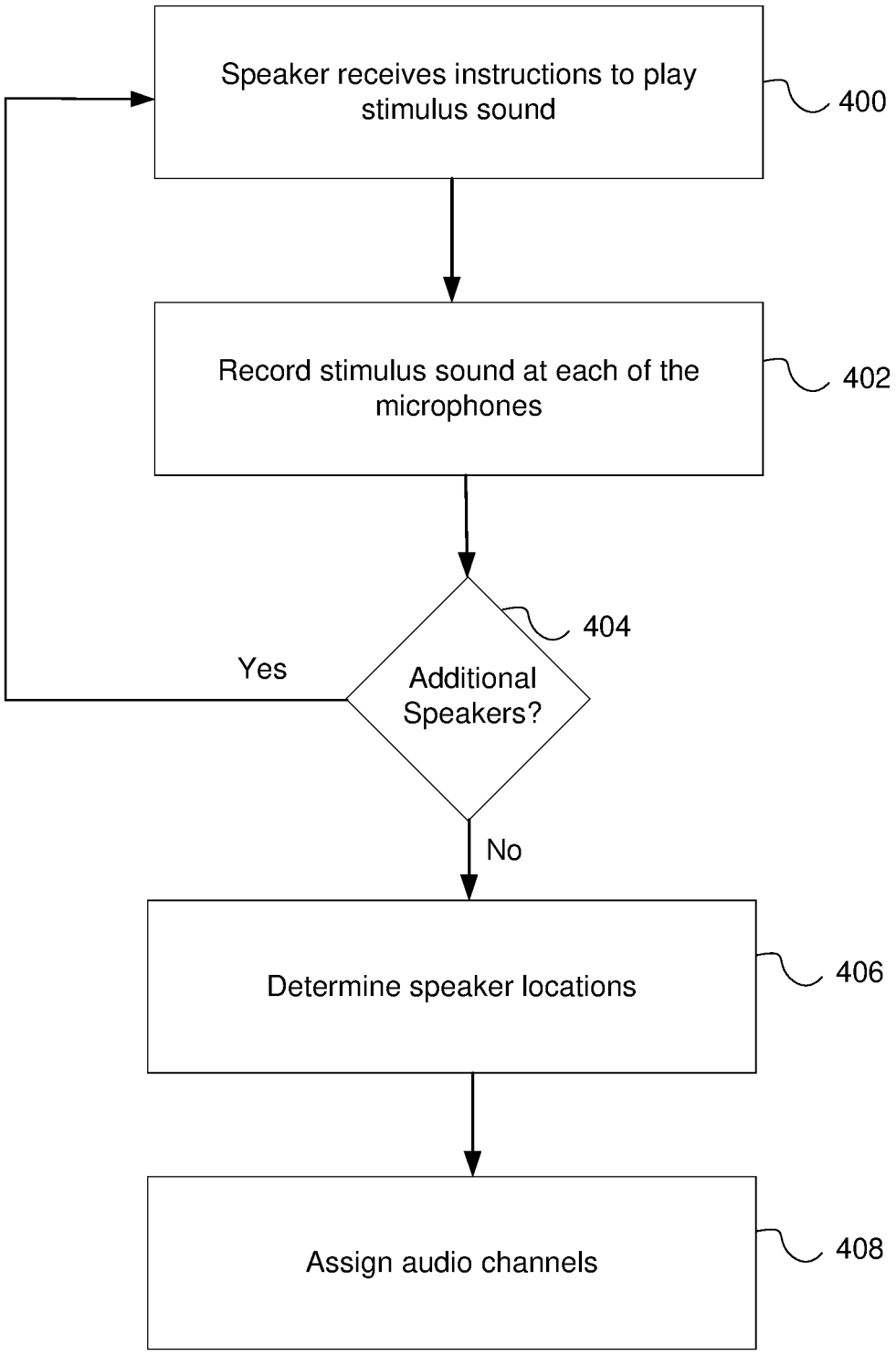
FIG. 4 is a flow chart illustrating the automatic speaker relative location detection operation according to embodiments of the disclosure.

FIG. 4 is a flow chart illustrating an operation for location detection of each of the speakers 102 performed by the firmware 114. The location detection may be performed for any of the embodiments shown in FIGS. 1-3, or any alternative embodiments discussed above. Before location detection starts, the microphone array 110 and firmware 114, are in wireless communication with all of the connected speakers 102 and the speakers 102 are individually identified. In some embodiments, the connected speakers 102 may also include the center speaker 200 or sub-woofer 202 shown in FIG. 2. In operation 400, the location detection begins by causing one of the speakers 102 to play a stimulus sound. Firmware 114 generates an instruction to the respective speaker 102 to play the stimulus sound and when the instructions are received at the speaker 102, the speaker outputs the stimulus sound. The stimulus sound may either be pre-recorded and stored, such as in a .wav file or any other audio file, or audio already streaming through the system can be recorded and stored to use as the stimulus. If the latter approach is used, the audio being sufficiently loud and feature-rich allows the microphones 112 to create signals having an adequate signal-to-noise (SNR) ratio for later analysis.

After the first speaker 102 plays the stimulus sound, in operation 402, simultaneous recordings are made from each of the microphones 112. For example, as speaker 1 plays its stimulus, simultaneous recordings are made from microphones M1, M2, M3, and M4.

Then, the location detection determines in operation 404 if there are additional speakers 102 remaining in the system. If yes, then the location detection returns to operation 400 and the stimulus sound is played through the next speaker 102, and recordings are made from each of the microphones 112 in operation 402. If no, then in operation 406, the detection location determines a location of each of the speakers 102 relative to the microphone array 110 based on the recordings from each of the microphones 112 for each speaker 102. Once a location has been determined for each of the speakers 102, then in operation 408, an audio channel is assigned to each of the speakers 102 based on the determined location of the speaker 102.

In operation 406, one or more forms of analysis may be used to determine the location of each of the speakers 102 based on the recording from each of the microphones 112. As will be understood by one skilled in the art, operation 406 may begin as soon as recordings are made from each of the microphones 112 after the first speaker plays its stimulus sound. That is, operation 406 may operate at the same time as operations 400 and 402.

In operation 408, an audio channel is assigned to each speaker 102 based on its determined location in operation 406.

In some embodiments, the firmware 114 may periodically confirm that the speakers 102 are assigned to the correct audio channel by not only performing the location detection shown in FIG. 4 during a start-up procedure, but also while audio is playing through the home theater system. For example, while audio is coming through the speakers, the microphones 114 may each record the audio from each respective speaker 102, as shown in FIG. 4, to confirm the speakers 102 are still located in the same location. This may be done by limiting the output of the audio to only a single speaker 102 at a time to perform the test. Further, in some embodiments, especially while the system is being test while audio is playing, different stimulus sounds may be played by each of the speakers 102 and recorded by the microphones 112 to determine the location of each speaker 102. That is, the stimulus sound played by each speaker 102 does not need to be indentical.

Many different types of sound analysis may be performed to determine the location of the speakers 102. A first example analysis to determine the location of each of the speakers 102 may include a time-of-flight (TOF) estimation. A TOF estimation involves computing cross-correlation sequences from the stimulus along with its associated microphone recordings. The sequences are a function of discrete time delay. The process may include using a generalized cross-correlation phase transform (GCC-PHAT). The cross-correlations may be generated in the frequency domain by estimating the cross-power spectral density (PSD) of stimulus and microphone recordings using Welch's method, for example. The complex-valued cross PSD may then be normalized by its magnitude at each frequency bin before it undergoes an inverse fast Fourier transform (IFFT) to yield an autocorrelation sequence for each speaker-mic pair. This sequence has peaks at indices representing discrete time delays. After rejecting non-plausible speaker-to-microphone distances, the peak representing the shortest time delay is interpreted to be the direct path from the speaker to the microphone array 110. Non-plausible distances may include a speaker-to-microphone distance less than one foot or more than is standard in wireless communication, for example. The distance may represent longitudinal or latitudinal distance from the microphone array 110. There may be some cases where the speakers 102 are mounted or positioned at different heights, i.e., the z plane as described above. Embodiments of the disclosure may also be used to identify the positional height of the speakers in the speaker system using the same analysis as above.

Another example analysis to determine the location of each of the speakers 102 may be performed on the recorded stimulus signals is an Error Minimization. An Error Minimization process makes use of a non-intuitive property of spatial geometry. First, the TOF analysis discussed above is performed and the TOF estimates generated as described above are multiplied by the speed of sound to achieve distance estimates. Assuming that the TOF measurements are accurate, a true location of the speaker 102 sits on a circle in the x-y plane whose radius is equal to the mean speaker-mic distance and whose center is the mean microphone location, i.e., the origin in the rectangular microphone array 110. Next, this circle is sampled at 360 locations. For each location, the expected vector of distances is compared to the vector of measured distances. One location will minimize the sum of squared errors between expected and measured distances, and this is reported as the location of that particular speaker 102. This process is repeated for all speakers 102.

While assigning relative speaker locations in operation 408, a confidence score may be determined that represents a degree of accuracy in the initial assignments. One use of a confidence score allows the automatic assignment system to accurately select a relative location when two speakers were initially assigned the same location. For example, with reference to FIGS. 1-3, if two speakers 102 happen to be initially mapped to the same relative location, the system may assign the location to the speaker 102 having the higher confidence score, which is more likely to be accurate. Another application of the confidence score is to, after the initial analysis is complete, assign final relative speaker locations beginning with the highest confidence value. In this way, if one of the location estimates is initially incorrect, it will likely have the lowest confidence score. Thus, in a four-speaker system, the first three speakers 102, all of which having higher confidence scores, will be assigned first, and the speaker 102 having the lowest confidence score is assigned the last remaining position.

One method of calculating a confidence score is to calculate M(x,y), which is the minimum sum-of-squared-errors between the expected and measured distances to all of the microphones 112 at room coordinate x, y (on the circle described above), and to calculate Q(x,y), which is the maximum sum-of-squared-errors between the expected and measured distances to all of the microphones 112 at room coordinate x, y (on the circle described above). Then, the confidence value may be calculated as (Q(x,y)−M(x,y))/Q (x,y). The value of the confidence will be between 0.0 and 1.0, with 1.0 being the highest confidence estimate.

After the relative speaker locations have been derived, each individual speaker 102 is mapped to a particular audio channel. If the user happens to place two speakers 102 such that they have the same bearing angle from the microphone array, the derived distance information may be used to resolve the classification by assigning the more distant speaker to be the rear, or surround channel.

In sound bar-based surround systems, such as 5.0 or 5.1 systems where the sound bar is located basically in the same plane as the front speakers, a two-microphone array may be used to accurately identify relative speaker locations. Although using only two microphones 112 in the microphone array 110 may introduce ambiguity in the angle estimate, in general the minimum angle of the front speakers 102 will be greater than the minimum angle of the rear speakers 102 relative to the sound bar. Using such information allows the position of the speakers 102 to be correctly determined. Also, in the event that a two-microphone system cannot determine whether the sound is in front of the microphone array or behind it, embodiments of the disclosure may assume that the speakers 102 are on the same side of the room, which should be a correct assumption in the majority of cases.

In addition, or as an alternative to the techniques described above, the time delay between signals received by various microphone pairs 112 in the microphone array 110 may be used to estimate the direction of the sound coming from individual speakers 102. The estimate of the angle to a speaker 102 relative to the center speaker 200 lets a specific audio channel, such as front/left, front/right, rear/left, rear/right, etc., to be assigned to that speaker 102. With more than two microphones 112, the angle of arrival estimate between various microphone pairs can also be used to determine the position of the speaker 102 in addition to its direction.

Also, although described as including two or four microphones 112, the microphone array 110 may include any number of microphones 112 greater than or equal to two. Increasing the number of microphones 112 increases the ability of the system to correctly identify relative placement of the sound-generating devices.

Further, although FIG. 1 is illustrated as including four speakers 102, and FIG. 2 is illustrated as a 5.1 system, embodiments of the disclosure may work with any number of speakers 102 in any arrangement, such as 5.1, 7.1, and 11.1 or any other speaker arrangement. Embodiments could also work in commercial environments, such as movie theaters, churches, auditoriums, or concert halls.

Even further, embodiments of the disclosure may be used in any situation to determine a relative location of audio-generating devices. For instance, embodiments of the disclosure could be used to identify relative locations of smoke detectors in a building by having each smoke detector generate an audio signal that is captured and analyzed by the microphone array, as described above. In some embodiments the smoke detectors may be automatically sequenced from a central control, while in other embodiments a user could manually activate the smoke detectors in succession for analysis. Many other solutions are possible.

Aspects of the disclosure may operate on particularly created hardware, firmware, digital signal processors, or on a specially programmed computer including a processor operating according to programmed instructions. The terms controller or processor as used herein are intended to include microprocessors, microcomputers, Application Specific Integrated Circuits (ASICs), and dedicated hardware controllers. One or more aspects of the disclosure may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a computer readable storage medium such as a hard disk, optical disk, removable storage media, solid state memory, Random Access Memory (RAM), etc. As will be appreciated by one of skill in the art, the functionality of the program modules may be combined or distributed as desired in various aspects. In addition, the functionality may be embodied in whole or in part in firmware or hardware equivalents such as integrated circuits, FPGA, and the like. Particular data structures may be used to more effectively implement one or more aspects of the disclosure, and such data structures are contemplated within the scope of computer executable instructions and computer-usable data described herein.

Computer storage media means any medium that can be used to store computer-readable information. By way of example, and not limitation, computer storage media may include RAM, ROM, Electrically Erasable Programmable Read-Only Memory (EEPROM), flash memory or other memory technology, Compact Disc Read Only Memory (CD-ROM), Digital Video Disc (DVD), or other optical disk storage, magnetic cassettes, magnetic tape, magnetic disk storage or other magnetic storage devices, and any other volatile or nonvolatile, removable or non-removable media implemented in any technology. Computer storage media excludes signals per se and transitory forms of signal transmission.

Communication media means any media that can be used for the communication of computer-readable information. By way of example, and not limitation, communication media may include coaxial cables, fiber-optic cables, air, or any other media suitable for the communication of electrical, optical, Radio Frequency (RF), infrared, acoustic or other types of signals.

Aspects of the present disclosure operate with various modifications and in alternative forms. Specific aspects have been shown by way of example in the drawings and are described in detail herein below. However, it should be noted that the examples disclosed herein are presented for the purposes of clarity of discussion and are not intended to limit the scope of the general concepts disclosed to the specific examples described herein unless expressly limited. As such, the present disclosure is intended to cover all modifications, equivalents, and alternatives of the described aspects in light of the attached drawings and claims.

References in the specification to embodiment, aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described regarding a particular aspect, such feature, structure, or characteristic can be employed in connection with another disclosed aspect whether or not such feature is explicitly described in conjunction with such other disclosed aspect.

EXAMPLES

Illustrative examples of the technologies disclosed herein are provided below. An embodiment of the technologies may include any one or more, and any combination of, the examples described below.

Example 1 is an audio speaker system for a home theater, comprising a plurality of microphones; a plurality of speakers, each speaker located at a different location in a room; a processor electrically connected to the plurality of microphones and wirelessly connected to the plurality of speakers. The processor is configured to generate an audio signal to send to each speaker of the plurality of speakers; output audio from each speaker of the plurality of speakers based on the audio signal; receive the audio at each microphone from each speaker of the plurality of speakers; determine a location of each speaker relative to the plurality of microphones based on the received audio at each microphone; and assign an audio channel to each speaker based on the determined location.

Example 2 is the audio speaker system of example 1, further comprising a sound bar, the sound bar including the plurality of microphones in an array and the processor.

Example 3 is the audio speaker system of example 2, wherein the array includes four microphones.

Example 4 is the audio speaker system of example 3, wherein the plurality of speakers includes four or more speakers.

Example 5 is the audio speaker system of any one of examples 1-4, wherein each microphone of the plurality of microphones is located in a respective speaker of the plurality of speakers.

Example 6 is the audio speaker system of any one of examples 1-5, wherein the processor is further configured to determine the location of each speaker by determining a height of each speaker relative to the plurality of microphones.

Example 7 is the audio speaker system of any one of examples 1-6, wherein the processor is further configured to determine the location of each speaker relative to the plurality of microphones by assigning a confidence score for a determined location of each speaker and setting the location of each speaker based on the confidence score.

Example 8 is the audio speaker system of any one of examples 1-7, wherein the audio signal is an audio signal currently streaming through the audio speaker system.

Example 9 is the audio speaker system of any one of examples 1-8, wherein the processor is further configured to generate the audio signal and determine the location of each speaker during a startup of the audio speaker system and periodically during operation of the audio speaker system, and reassign an audio channel to each speaker if the determined location changes during operation of the audio speaker system.

Example 10 is the audio speaker system of any one of examples 1-9, wherein the processor is further configured to determine the location of each speaker based on a time of flight of the received audio at each microphone from each of the speakers of the plurality of speakers.

Example 11 is a method for determining a location of a plurality of speakers in a home theater audio system, comprising generating audio at a first speaker; receiving the audio from the first speaker at two or more microphones; generating audio at a second speaker; receiving the audio from the second speaker at the two or more microphones; determining a location of the first speaker and the second speaker relative to the two or more microphones based on the received audio at the two or more microphones; and assigning a first audio channel to the first speaker based on the determined location of the first speaker relative to the two or more microphones and assigning a second audio channel to the second speaker based on the determined location of the second speaker relative to the two or more microphones.

Example 12 is the method of example 11, wherein the two or more microphones are located in an array in a sound bar.

Example 13 is the method of example 12, wherein the array includes four microphones.

Example 14 is the method of any one of examples 11-13, further comprising determining the location of each speaker relative to the plurality of microphones by assigning a confidence score for a determined location of each speaker and setting the location of each speaker based on the confidence score.

Example 15 is the method of any one of examples 11-14, further comprising determining the location of each speaker by determining a height of each speaker relative to the plurality of microphones.

Example 16 is the method of any one of examples 11-15, wherein the audio signal is an audio signal currently streaming through the audio speaker system.

Example 17 is the method of any one of examples 11-16, further comprising generating the audio signal and determining the location of each speaker during a startup of the audio speaker system and periodically during operation of the audio speaker system, and reassigning an audio channel to each speaker if the determined location changes during operation of the audio speaker system.

Example 18 is the method of any one of examples 11-17, wherein determining the location of each speaker relative to the two or more microphones includes assigning a confidence score for a determined location of each speaker and setting the location of each speaker based on the confidence score.

Example 19 is the method of any one of examples 11-18, further comprising generating audio at a third speaker; receiving the audio from the third speaker at the two or more microphones; determining a location of the third speaker relative to the two or more microphones based on the received audio at the two or more microphones; and assigning a third audio channel to the third speaker based on the determined location of the third speaker relative to the two or more microphones.

Example 20 is the method of example 19, further comprising generating audio at a fourth speaker; receiving the audio from the fourth speaker at the two or more microphones; determining a location of the fourth speaker relative to the two or more microphones based on the received audio at the two or more microphones; and assigning a fourth audio channel to the fourth speaker based on the determined location of the fourth speaker relative to the two or more microphones.

The previously described versions of the disclosed subject matter have many advantages that were either described or would be apparent to a person of ordinary skill. Even so, these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect, that feature can also be used, to the extent possible, in the context of other aspects.

Also, when reference is made in this application to a method having two or more defined steps or operations, the defined steps or operations can be carried out in any order or simultaneously, unless the context excludes those possibilities.

Although specific aspects of the disclosure have been illustrated and described for purposes of illustration, it will be understood that various modifications may be made without departing from the spirit and scope of the disclosure.

The invention claimed is:

1. An audio speaker system for a home theater, comprising:

a plurality of microphones;

a plurality of speakers, each speaker located at a different location in a room; and a processor electrically connected to the plurality of microphones and wirelessly connected to the plurality of speakers, the processor configured to generate an audio signal to send to each speaker of the plurality of speakers, cause each of the plurality of speakers to output audio based on the audio signal, determine whether each of the plurality of speakers has outputted audio, responsive to a determination that each of the speakers has outputted audio determine a location of each speaker relative to the plurality of microphones based on an audio received at each microphone by assigning a confidence score for the determined location of each speaker and setting the location of each speaker based on the confidence score, and assign an audio channel to each speaker based on the determined location.

2. The audio speaker system of claim 1 further comprising a sound bar, the sound bar including the plurality of microphones in an array and the processor.

3. The audio speaker system of claim 2 wherein the array includes four microphones.

4. The audio speaker system of claim 3 wherein the plurality of speakers includes four or more speakers.

5. The audio speaker system of claim 1 wherein each microphone of the plurality of microphones is located in a respective speaker of the plurality of speakers.

6. The audio speaker system of claim 1 wherein the processor is further configured to determine the location of each speaker by determining a height of each speaker relative to the plurality of microphones.

7. The audio speaker system of claim 1 wherein the audio signal is an audio signal currently streaming through the audio speaker system.

8. The audio speaker system of claim 1 wherein the processor is further configured to determine the location of each speaker based on a time of flight of the received audio at each microphone from each of the speakers of the plurality of speakers.

9. The audio speaker system of claim 1 wherein the audio signal that is sent to each speaker of the plurality of speakers is the same audio signal.

10. An audio speaker system for a home theater, comprising a plurality of microphones;

a plurality of speakers, each speaker located at a different location in a room; and a processor electrically connected to the plurality of microphones and wirelessly connected to the plurality of speakers, the processor configured to generate an audio signal to send to each speaker of the plurality of speakers, cause each of the plurality of speakers to output audio based on the audio signal, determine whether each of the plurality of speakers has outputted audio, responsive to a determination that each of the speakers has outputted audio determine a location of each speaker relative to the plurality of microphones based on an audio received at each microphone, assign an audio channel to each speaker based on the determined location, generate the audio signal and determine the location of each speaker during a startup of the audio speaker system and periodically during operation of the audio speaker system, and reassign an audio channel to each speaker if the determined location changes during operation of the audio speaker system.

11. The audio speaker system of claim 10 further comprising a sound bar, the sound bar including the plurality of microphones in an array and the processor.

12. The audio speaker system of claim 10 wherein the processor is further configured to determine the location of each speaker by determining a height of each speaker relative to the plurality of microphones.

13. The audio speaker system of claim 10 wherein the processor is further configured to determine the location of each speaker based on a time of flight of the received audio at each microphone from each of the speakers of the plurality of speakers.

14. A method for determining a location of a plurality of speakers in a home theater audio system, comprising:

generating audio at a first speaker;

receiving the audio from the first speaker at two or more microphones;

generating audio at a second speaker;

receiving the audio from the second speaker at the two or more microphones;

determining whether there are any other speakers to generate audio;

responsive to a determination that there are no other speakers to generate audio, determining a location of the first speaker and the second speaker relative to the two or more microphones based on the received audio at the two or more microphones by assigning a confidence score for a determined location of each speaker and setting the location of each speaker based on the confidence score; and assigning a first audio channel to the first speaker based on the determined location of the first speaker relative to the two or more microphones and assigning a second audio channel to the second speaker based on the determined location of the second speaker relative to the two or more microphones.

15. The method of claim 14 wherein the two or more microphones are located in an array in a sound bar.

16. The method of claim 15 wherein the array includes four microphones.

17. The method of claim 14 further comprising determining the location of each speaker by determining a height of each speaker relative to the plurality of microphones.

18. The method of claim 14 wherein the audio signal is an audio signal currently streaming through the audio speaker system.

19. The method of claim 14 further comprising:

generating the audio signal and determining the location of each speaker during a startup of the audio speaker system and periodically during operation of the audio speaker system, and reassigning an audio channel to each speaker if the determined location changes during operation of the audio speaker system.

20. The method of claim 14 further comprising:

generating audio at a third speaker;

receiving the audio from the third speaker at the two or more microphones;

determining a location of the third speaker relative to the two or more microphones based on the received audio at the two or more microphones; and assigning a third audio channel to the third speaker based on the determined location of the third speaker relative to the two or more microphones.

21. The method of claim 20 further comprising:

generating audio at a fourth speaker;

receiving the audio from the fourth speaker at the two or more microphones;

determining a location of the fourth speaker relative to the two or more microphones based on the received audio at the two or more microphones; and assigning a fourth audio channel to the fourth speaker based on the determined location of the fourth speaker relative to the two or more microphones.

* * * * *